US008056517B2

(12) United States Patent
Kim et al.

(10) Patent No.: US 8,056,517 B2
(45) Date of Patent: Nov. 15, 2011

(54) VARIABLE VALVE LIFT APPARATUS

(75) Inventors: Back Sik Kim, Osan (KR); Ingee Suh, Yongin (KR); Dong Hee Han, Seoul (KR); Woo Tae Kim, Suwon (KR); Hyung Ick Kim, Gunpo (KR); Myungsik Choi, Seoul (KR); Dae Sung Kim, Hwaseong (KR); Kyoung Pyo Ha, Suwon (KR)

(73) Assignee: Hyundai Motor Company, Seoul (KR)

( * ) Notice: Subject to any disclaimer, the term of this patent is extended or adjusted under 35 U.S.C. 154(b) by 649 days.

(21) Appl. No.: 12/130,610

(22) Filed: May 30, 2008

(65) Prior Publication Data

US 2009/0151669 A1 Jun. 18, 2009

(30) Foreign Application Priority Data

Dec. 14, 2007 (KR) ..... 10-2007-0131653

(51) Int. Cl.
*F01L 1/34* (2006.01)

(52) U.S. Cl. ..... 123/90.16

(58) Field of Classification Search ..... 123/90.16, 123/90.39, 90.44, 90.15, 90.4
See application file for complete search history.

(56) References Cited

U.S. PATENT DOCUMENTS

| | | | | |
|---|---|---|---|---|
| 7,082,911 | B2 * | 8/2006 | Ezaki et al. | 123/90.15 |
| 7,252,058 | B2 * | 8/2007 | Tashiro | 123/90.16 |
| 7,451,729 | B2 * | 11/2008 | Sugiura et al. | 123/90.16 |
| 7,721,691 | B2 * | 5/2010 | Tateno | 123/90.16 |
| 2006/0249109 | A1 * | 11/2006 | Ezaki et al. | 123/90.16 |
| 2009/0277408 | A1 * | 11/2009 | Tateno et al. | 123/90.16 |

FOREIGN PATENT DOCUMENTS

WO WO 2007058092 A1 * 5/2007

* cited by examiner

*Primary Examiner* — Thomas Denion
*Assistant Examiner* — Daniel Bernstein
(74) *Attorney, Agent, or Firm* — Morgan, Lewis & Bockius LLP

(57) ABSTRACT

A variable valve lift apparatus of an engine includes: a control shaft; a driving arm rotatable around the control shaft by a cam of a camshaft; a first rocker arm rotatable around the control shaft, that is operated by the driving arm so as to drive a first valve through a first swing arm; a second rocker arm rotatable around the control shaft, that is operated by the driving arm so as to drive a second valve through a second swing arm; and a mediating device rotatable around the control shaft, that transmits a movement of the driving arm to the first and second rocker arms.

6 Claims, 4 Drawing Sheets

VARIABLE VALVE LIFT APPARATUS

CROSS-REFERENCE TO RELATED APPLICATION

This application claims priority to, and the benefit of, Korean Patent Application No. 10-2007-0131653, filed in the Korean Intellectual Property Office on Dec. 14, 2007, the entire contents of which are incorporated herein by reference.

BACKGROUND OF THE INVENTION (a) Field of the Invention

The present invention relates to a variable valve lift apparatus of an engine.

(b) Description of the Related Art

An internal combustion engine generates power by burning a mixture of air and fuel in a combustion chamber. Intake valves are operated by a camshaft in order to intake the air, and the air is drawn into the combustion chamber while the intake valves are open. In addition, exhaust valves are operated by the camshaft, and exhaust gas is expelled from the combustion chamber while the exhaust valves are open.

Optimal opening/closing timing of the intake and exhaust valves depends on the rotation speed of the engine. Variable valve lift (VVL) apparatus have therefore been developed. These apparatus allow different valve timing depending on the engine speed.

Such a VVL apparatus should minimize power loss in driving the valves using torque of the camshaft. In addition, it should be symmetrical, so it can be installed in both banks in a V-engine.

The above information disclosed in this Background section is only for enhancement of understanding of the background of the invention and therefore it may contain information that does not form the prior art that is already known in this country to a person of ordinary skill in the art.

SUMMARY OF THE INVENTION

A variable valve lift apparatus of an engine includes: a control shaft; a driving arm rotatable around the control shaft by a cam of a camshaft; a first rocker arm rotatable around the control shaft, that is operated by the driving arm so as to drive a first valve through a first swing arm; a second rocker arm rotatable around the control shaft, that is operated by the driving arm so as to drive a second valve through a second swing arm; and a mediating device rotatable around the control shaft that transmits a movement of the driving arm to the first and second rocker arms.

The control shaft may have a cam that is eccentrically rotatable around an axis of the control shaft. The mediating device may have a mediating arm that extends from a body on the circular cam between the driving arm and the rocker arms, and a drive shaft that is connected with the mediating arm, between the driving arm and the rocker arms.

The apparatus may also include a first bearing contacting the first rocker arm, a second bearing contacting the second rocker arm, and a third bearing contacting the driving arm on the drive shaft.

The first rocker arm may have a first mediating device contacting surface, and the second rocker arm may have a second mediating device contacting surface. The mediating device contacting surfaces may have different profiles.

The apparatus may also have a roller at a cam contact portion of the driving arm such that the driving arm contacts the cam through the roller.

The apparatus may also have a first plunger that is supported by a first lost motion spring and supports the first rocker arm; and a second plunger that is supported by a second lost motion spring and supports the second rocker arm.

The apparatus may further include: an oil supply hole directed to the drive shaft, an oil supply hole directed to the first plunger, and an oil supply hole directed to the first swing arm provided on the first rocker arm; an oil supply hole directed to the drive shaft, an oil supply hole directed to the second plunger, and an oil supply hole directed to the second swing arm provided on the second rocker arm; and an oil supply hole directed to the drive shaft and an oil supply hole directed to the roller provided on the driving arm.

REFERENCE NUMERALS

Reference Numerals

| | | | |
|---|---|---|---|
| 10: | camshaft | 190, 290: | first and second valves |
| 120: | HLA | | |
| 15: | cam | 300: | driving arm |
| 375: | circular cam | 310: | roller |
| 150, 250, 350: | first, second, and third bearings | 360: | mediating device |
| | | 370: | control shaft |
| 160, 260: | first and second mediating arms | 380: | drive shaft |
| | | θ: | angular difference |
| 162: | circular body | 172, 272: | oil supply holes directed to plunger |
| 170, 270: | first and second rocker arms | 173, 273: | oil supply holes directed to drive shaft |
| 171, 271: | first and second protrusion | | |
| 175, 275: | first and second contacting surfaces | 174, 274: | oil supply holes directed to swing arm |
| 180, 280: | first and second plungers | 302: | oil supply hole directed to drive shaft |
| 182: | lost motion spring | 303: | oil supply hole directed to roller |
| 185, 285: | first and second swing arms | | |
| 187: | roller bearing | | |

DETAILED DESCRIPTION OF PREFERRED EMBODIMENTS

An exemplary embodiment of the present invention will hereinafter be described in detail with reference to the accompanying drawings.

Figure 1:
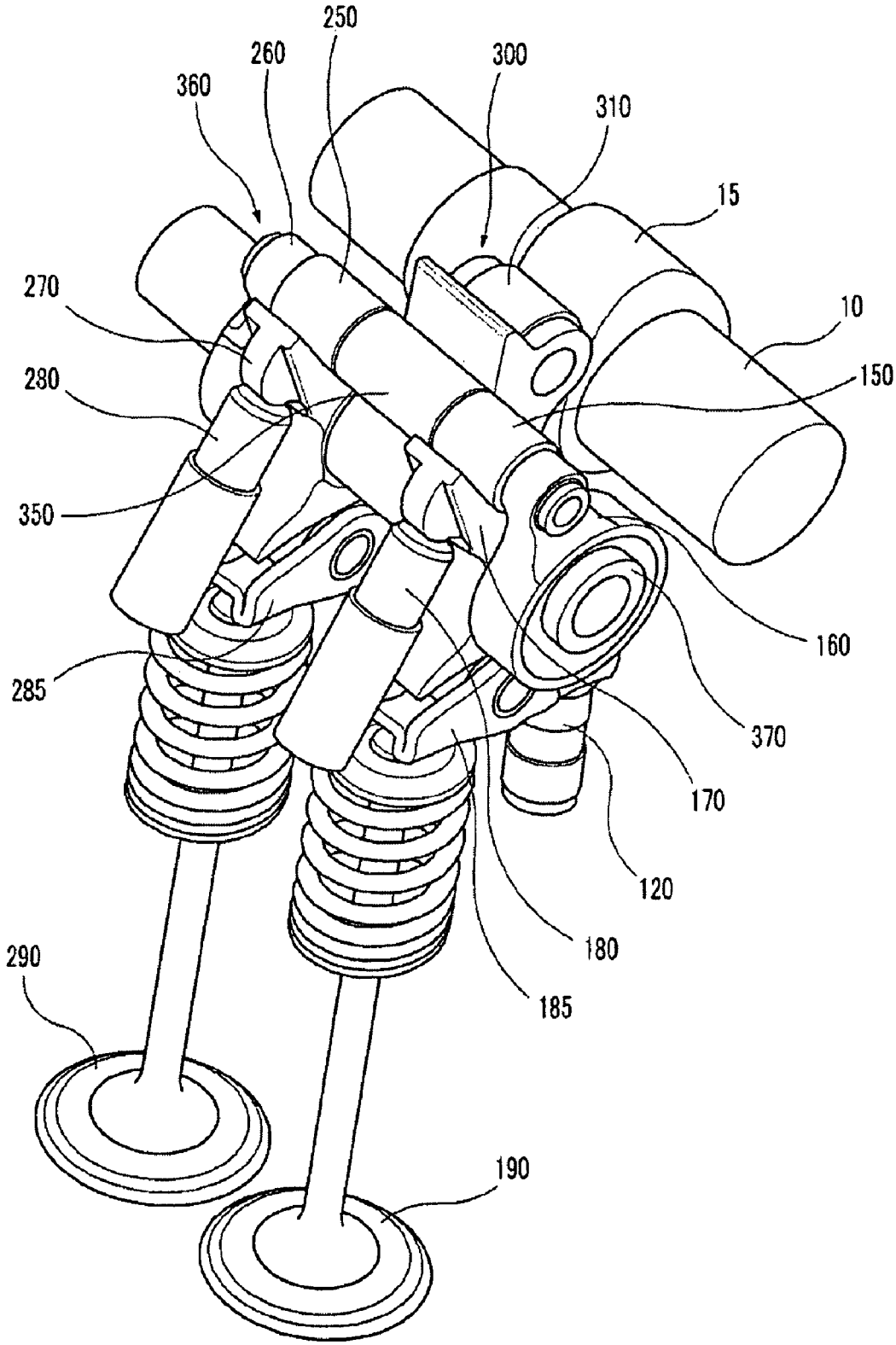
FIG. 1 is a perspective view of a VVL apparatus according to an exemplary embodiment of the present invention.

Referring to FIG. 1, a VVL apparatus according to an exemplary embodiment of the present invention drives a first valve 190 and a second valve 290 with variable valve lifts, by using a cam 15 of a camshaft 10.

The VVL apparatus according to an exemplary embodiment of the present invention includes: a driving arm 300 that is rotated by the cam 15 of the camshaft 10; a first rocker arm 170 that is operated by the driving arm 300 so as to drive the first valve 190 through a first swing arm 185; a second rocker arm 270 that is operated by the driving arm 300 so as to drive the second valve 290 through a second swing arm 285; a mediating device 360 that transmits movement of the driving arm 300 to the rocker arms 170 and 270; and a control shaft 370, around which the driving arm 300, the rocker arms 170 and 270, and the mediating device 360 are rotatable.

A roller 310 is provided at a cam contact portion of the driving arm 300 such that the driving arm 300 contacts the cam 15 through the roller 310.

The control shaft 370 includes a circular cam 375 (refer to FIG. 2) that rotates eccentrically around the axis of the control shaft 370.

The mediating device 360 includes a first mediating arm 160 that extends from a circular body 162 (refer to FIG. 2) on the circular cam 375 at an angle between the driving arm 300 and the first and second rocker arms 170 and 270, and a drive shaft 380 (refer to FIG. 2) that is connected with the first mediating arm 160 between the driving arm 300 and the first and second rocker arms 170 and 270.

A first bearing 150 contacting the first rocker arm 170, a second bearing 250 contacting the second rocker arm 270, and a third bearing 350 contacting the driving arm 300 are provided on the drive shaft 380.

A second mediating arm 260 is provided on the control shaft 370 opposite the first mediating arm 160. The drive shaft 380 interconnects the first and second mediating arms 160 and 260.

When the cam 15 presses the driving arm 300 by the rotation of the camshaft 10, the driving arm 300 accordingly presses the mediating device 360. Consequently, the mediating device 360 presses the first and second rocker arms 170 and 270, and therefore the first and second rocker arms 170 and 270 rotate. As the first and second rocker arms 170 and 270 rotate, first and second protrusions 171 and 271 (refer to FIG. 2 and FIG. 3) at bottoms of the first and second rocker arms 170 and 270 press the first and second swing arms 185 and 285 such that the first and second valves 190 and 290 are opened.

Figure 2:
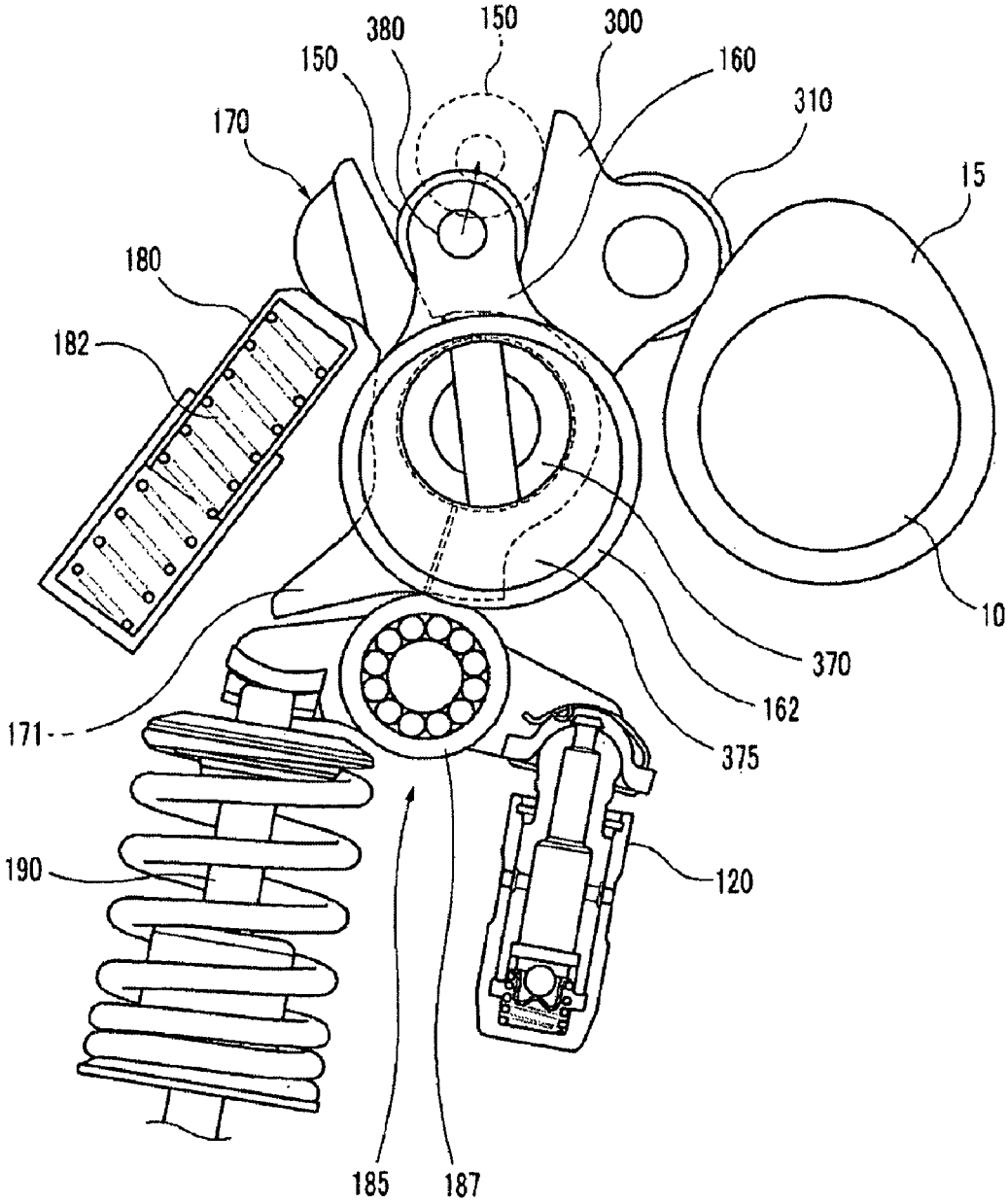
FIG. 2 is a side view of a VVL apparatus according to an exemplary embodiment of the present invention during operation.

The first rocker arm 170 is supported by a first plunger 180 that is supported by a first lost motion spring 182 (refer to FIG. 2). In the same way, the second rocker arm 270 is supported by a second plunger 280 that is supported by a second lost motion spring (not shown).

Operation of the VVL apparatus according to an exemplary embodiment of the present invention is hereinafter described in detail with reference to FIG. 2, which illustrates only the first rocker arm 170. The operation of only the first valve 190 will be described with reference to FIG. 2. Operation of the second valve 290 may be identical to that of the first valve 190, and will not be described for succinctness' sake.

As the camshaft 10 rotates, the cam 15 presses the driving arm 300 through the roller 310, minimizing friction between the cam 15 and the driving arm 300.

The driving arm 300 in turn presses the mediating device 360. In further detail, the driving arm 300 presses the drive shaft 380 through the third bearing 350, minimizing friction between the driving arm 300 and the drive shaft 380. Since the drive shaft 380 is connected with the control shaft 370 through the first and second mediating arms 160 and 260, the drive shaft 380 rotates around the control shaft 370 when pressed by the driving arm 300.

Therefore, the drive shaft 380 presses the first rocker arm 170. The first and second bearings 150 and 270 are provided where the drive shaft 380 contacts the first rocker arm 170 and the second rocker arm 270, respectively. Therefore, friction between the drive shaft 380 and the first and second rocker arms 170 and 270 is minimized.

The first rocker arm 170 that is pressed by the drive shaft 380 rotates around the control shaft 370. The first protrusion 171 at the bottom of the first rocker arm 170 presses the first swing arm 185. Therefore, the first swing arm 185 (one end of which is supported by a hydraulic lash adjuster [HLA] 120) presses the first valve 190 open.

Since a roller bearing 187 is provided between the first swing arm 185 and the first protrusion 171, friction is minimized.

In order to vary valve lift, the control shaft 370 is rotated by an actuator such as a motor (not shown). Consequently, the circular cam 375 rotates, and therefore the first mediating arm 160 is raised or lowered. In FIG. 2, a raised position of the first bearing 150 is illustrated with a dotted line.

When the first bearing 150 is raised by the rising of the first mediating arm 160, the first rocker arm 170 maintains contact to the raised first bearing 150 by a force of the first plunger that is elastically supported by the first lost motion spring 182. That is, the first rocker arm 170 rotates clockwise in FIG. 2. The first protrusion 171 at the bottom of the first rocker arm 170 accordingly rotates clockwise.

When the cam 15 presses the driving arm 300 at this state, the first swing arm 185 is driven only after the first rocker arm 170 reversely rotates by an amount of the clockwise rotation. Consequently, the valve lift is decreased. In this case, the valve timing is also varied.

Since the valve lift can be varied depending on a rotation angle the control shaft 370, the valve lift can be continuously varied by the VVL apparatus according to an exemplary embodiment of the present invention.

The drive shaft 380 is raised or lowered in order to vary the valve lift. The first, second, and third bearings 150, 250, and 350 on the drive shaft 380 minimize friction between the drive shaft 380 and the driving arm 300, and between the drive shaft 380 and the first and second rocker arms 170 and 270 while the drive shaft 380 moves up and down.

According to the VVL apparatus according to an exemplary embodiment of the present invention, only a negligible level of resistive force may occur while raising the drive shaft 380 by rotating the control shaft 370. When the drive shaft 380 is lowered, only the elasticity of the lost motion spring 182 may be overcome. In this case, since the lost motion spring 182 is pressed by the first rocker arm 170 while the drive shaft 380 obliquely moves with respect to the first rocker arm 170, the resistive force against the movement of the drive shaft 380 is very small.

Therefore, the VVL apparatus according to an exemplary embodiment of the present invention is easily controlled with an actuator of very small capacity, and thus is very responsive.

Furthermore, according to the VVL apparatus of an exemplary embodiment of the present invention, the first and second valves 190 and 290 may be driven with different valve lifts, which is described in detail with reference to FIG. 3. For ease of description, the first and second rocker arms 170 and 270 are both illustrated in FIG. 3.

Figure 3:
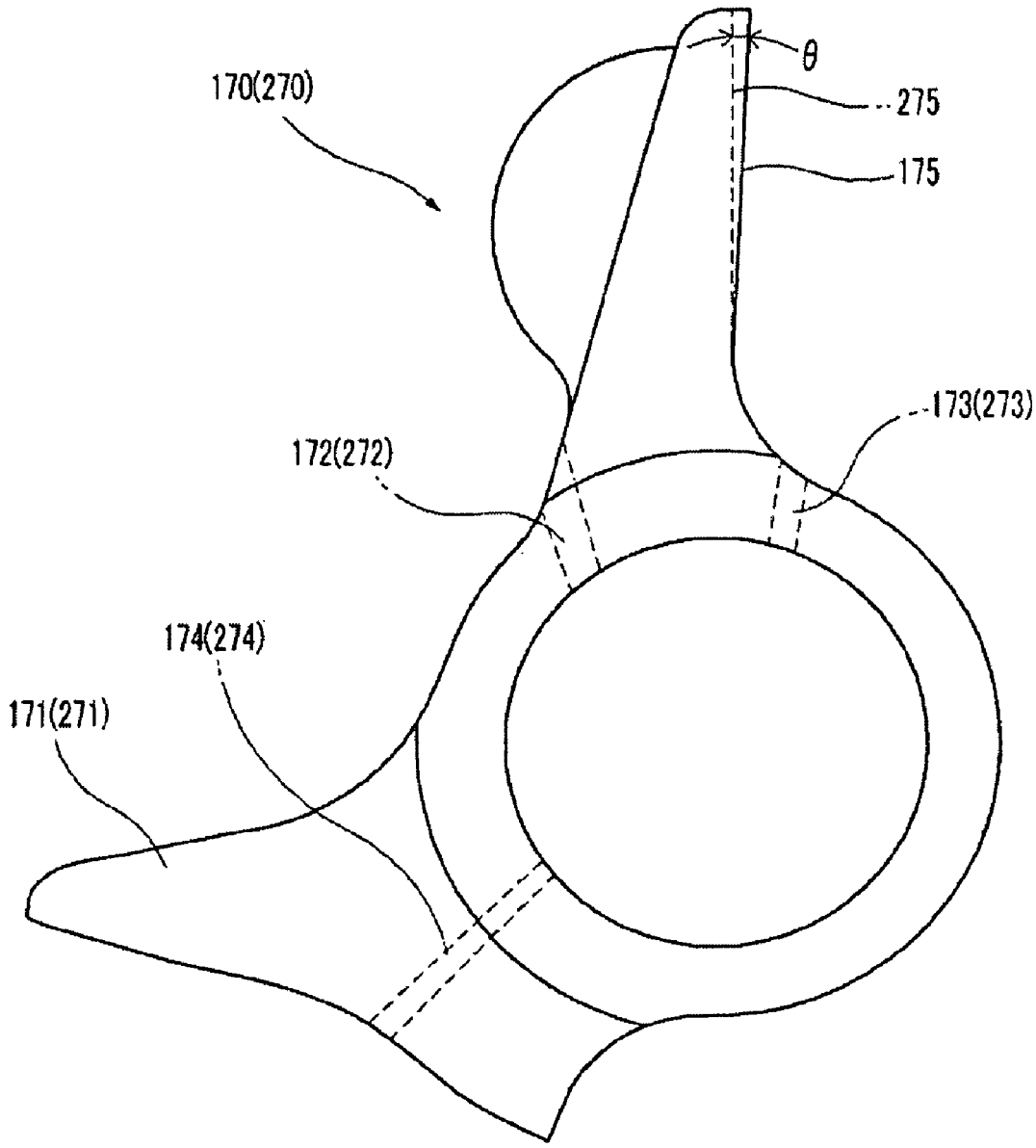
FIG. 3 is a side view of rocker arms of a VVL apparatus according to an exemplary embodiment of the present invention.

As shown in FIG. 3, the first rocker arm 170 and the second rocker arm 270 may have the same basic shapes. However, a first mediating device contacting surface 175 of the first rocker arm 170 has a different profile than a second mediating device contacting surface 275 of the second rocker arm 270. For example, in the illustrated embodiment, the first contacting surface 175 of the first rocker arm 170 and the second contacting surface 275 of the second rocker arm 270 are both planar, but have an angular difference θ therebetween.

In this case, the valve lifts of the first and second valves 190 and 290 are the same when the first and second valves 190 and 290 are driven at a maximum valve lift. However, when the valve lift is varied, the first and second valves 190 and 290 may have different valve lifts.

In more detail, when the drive shaft 380 is raised by rotating the control shaft 370 so as to decrease the valve lift, the first and second rocker arms 170 and 270 rotate clockwise and maintain contact with the drive shaft 380. In this case, rotation angles of the first rocker arm 170 and the second rocker arm 270 are different from each other. Therefore, the valve lifts of the first and second valves 190 and 290 are different.

While only an angular difference θ is illustrated, maximum valve lifts of the valves 190 and 290 may differ in other ways, such as by providing different thicknesses of the first and second contacting surfaces 175 and 275, or differently curved profiles.

The availability of different valve lifts to the first and second valves 190 and 290 has significant results. Air intake amounts and flow rates through the first and second valves 190 and 290 may be different, and thus a strong swirl of the intake air may be induced in the combustion chamber. That is, the valve lifts may be further optimally controlled for better combustion in the combustion chamber if different valve lifts are available to the valves.

The VVL apparatus according to an exemplary embodiment of the present invention employs oil lubrication in order to minimize friction, and this will be described in detail with reference to FIG. 4 and FIG. 5.

As shown in FIG. 3, an oil supply hole 173 directed to the drive shaft 380, an oil supply hole 172 directed to the first plunger 180, and an oil supply hole 174 directed to the first swing arm 185 are provided in the first rocker arm 170. An oil supply hole 273 directed to the drive shaft 380, an oil supply hole 272 directed to the second plunger 280, and an oil supply hole 274 directed to the second swing arm 285 are provided in the second rocker arm 270.

Figure 4:
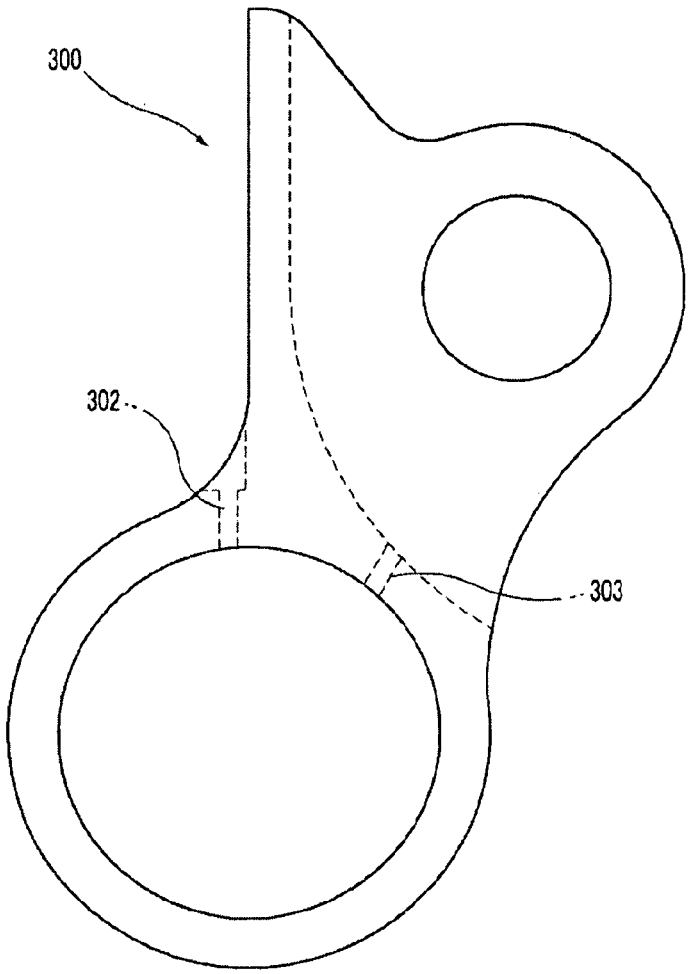
FIG. 4 is a side view of a driving arm of a VVL apparatus according to an exemplary embodiment of the present invention.

As shown in FIG. 4, an oil supply hole 302 directed to the drive shaft 380 and an oil supply hole 303 directed to the roller 310 are provided in the driving arm 300.

In addition, a penetration hole (not shown) for oil supply is formed inside the control shaft 370, and the oil supply holes 172, 272, 173, 273, 174, 274, 302, and 303) are supplied with oil therefrom.

Therefore, oil lubrication is applied to all moving parts where friction may occur while driving the first and second valves 190 and 290 by rotating the camshaft 10, and accordingly, power loss due to friction is minimized in the VVL apparatus according to an exemplary embodiment of the present invention.

Figure 5:
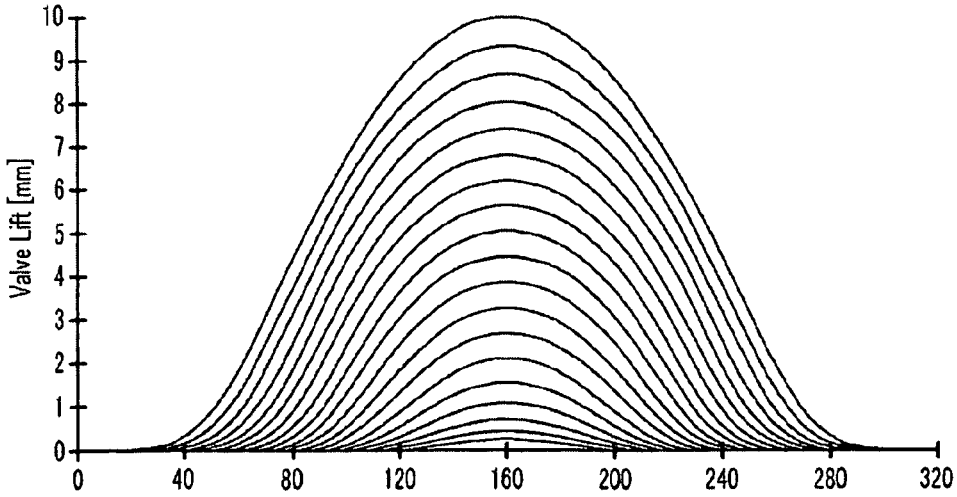
FIG. 5 is a diagram that shows valve timing and valve lift available by a VVL apparatus according to an exemplary embodiment of the present invention.

As shown in FIG. 5, various valve lifts may be achieved by the VVL apparatus according to an exemplary embodiment of the present invention, and variation of valve timing may be achieved together with the variation of the valve lift. In addition, such a feature may be obtained with respect to a reverse rotation of a camshaft. In more detail, when the drive shaft 380 is moved in order to vary the valve lift, basic positions of the rocker arms 170 and 270 are changed, thereby changing basic positions of their protrusions 171 and 172. Therefore, the crank angle at which the protrusions 171 and 172 start to press swing arms 185 and 285 is also changed, and consequently, valve timing and duration are also affected.

The VVL apparatus according to an exemplary embodiment of the present invention may be commonly used for both banks of a V-engine since the VVL apparatus may be installed therein by merely changing the installing direction. Therefore, common use of parts, which is a universal goal of the automotive industry, may be achieved. Further, the VVL apparatus may be easily modularized. Furthermore, installation height of a VVL apparatus may be similar to that of a camshaft, and ease of assembly is achieved.

While this invention has been described in connection with what is presently considered to be practical exemplary embodiments, it is to be understood that the invention is not limited to the disclosed embodiments. On the contrary, it is intended to cover various modifications and equivalent arrangements included within the spirit and scope of the appended claims.

What is claimed is:

1. A variable valve lift apparatus of an engine, comprising:
- a control shaft;
- a driving arm coupled around the control shaft and rotatable by a cam of a camshaft;
- a first rocker arm rotatably coupled around the control shaft, that is operated by the driving arm so as to drive a first valve through a first swing arm;
- a second rocker arm rotatably coupled to the control shaft, that is operated by the driving arm so as to drive a second valve through a second swing arm; and
- a mediating device rotatably coupled to the control shaft, that transmits a movement of the driving arm to the first rocker arm and the second rocker arm,
- wherein the control shaft comprises a circular cam that is eccentrically and rotatably coupled around an axis of the control shaft and wherein the mediating device comprises:
  - a circular body rotatably enclosing the circular cam,
  - a mediating arm that extends from the circular body in a direction between the driving arm and the rocker arms, and
  - a drive shaft that is connected with an end portion of the mediating arm and is disposed between the driving arm and the rocker arms to simultaneously contact the driving arm and the rocker arm so that a rotating motion of the driving arm is transferred to the rocker arms via the drive shaft.

2. The variable valve lift apparatus of claim 1, further comprising a first bearing contacting the first rocker arm, a second bearing contacting the second rocker arm, and a third bearing contacting the driving arm on the drive shaft.

3. The variable valve lift apparatus of claim 1, wherein the first rocker arm comprises a first mediating device contacting surface, and the second rocker arm comprises a second mediating device contacting surface, wherein the mediating device contacting surfaces comprise different profiles.

4. The variable valve lift apparatus of claim 1, further comprising a roller at a cam contact portion of the driving arm such that the driving arm contacts the cam through the roller.

5. The variable valve lift apparatus of claim 1, further comprising a first plunger that is supported by a first lost motion spring and supports the first rocker arm; and a second plunger that is supported by a second lost motion spring and supports the second rocker arm.

6. The variable valve lift apparatus of claim 5, further comprising:
- an oil supply hole directed to the drive shaft, an oil supply hole directed to the first plunger, and an oil supply hole directed to the first swing arm provided on the first rocker arm;
- an oil supply hole directed to the drive shaft, an oil supply hole directed to the second plunger, and an oil supply hole directed to the second swing arm provided on the second rocker arm; and
- an oil supply hole directed to the drive shaft and an oil supply hole directed to the roller provided on the driving arm.

* * * * *